US009186033B2

(12) United States Patent
Kubasiewicz

(10) Patent No.: US 9,186,033 B2
(45) Date of Patent: Nov. 17, 2015

(54) SURFACE CLEANING WITH CONCURRENTLY USABLE PRESPRAY AND RINSE UNITS

(71) Applicant: Edward Michael Kubasiewicz, Aspen, CO (US)

(72) Inventor: Edward Michael Kubasiewicz, Aspen, CO (US)

( * ) Notice: Subject to any disclaimer, the term of this patent is extended or adjusted under 35 U.S.C. 154(b) by 184 days.

(21) Appl. No.: 13/941,994

(22) Filed: Jul. 15, 2013

(65) Prior Publication Data

US 2014/0020719 A1 Jan. 23, 2014

Related U.S. Application Data

(62) Division of application No. 12/776,413, filed on May 9, 2010, now Pat. No. 8,485,203.

(51) Int. Cl.

| | |
|---|---|
| ***B08B 3/02*** | (2006.01) |
| ***A47L 11/40*** | (2006.01) |
| ***B08B 5/04*** | (2006.01) |
| ***B65H 75/42*** | (2006.01) |
| ***B65H 75/44*** | (2006.01) |

(52) U.S. Cl.

CPC ..... *A47L 11/4088* (2013.01); *A47L 11/4083* (2013.01); *B08B 3/026* (2013.01); *B08B 5/04* (2013.01); *B65H 75/42* (2013.01); *B65H 75/4478* (2013.01); *B65H 2701/33* (2013.01); *B65H 2701/34* (2013.01)

(58) Field of Classification Search

None

See application file for complete search history.

(56) References Cited

U.S. PATENT DOCUMENTS

2006/0027253 A1* 2/2006 Kaiser ..... 134/94.1

* cited by examiner

*Primary Examiner* — Jason Ko

(74) *Attorney, Agent, or Firm* — Dinsmore & Shohl LLP

(57) ABSTRACT

A soiled surface cleaning system is described for pre spraying soiled surface areas, and for rinsing and extracting the pre sprayed soiled surface areas, wherein the pre spraying of the soiled surface areas does not have to be stopped in order to perform the rinsing and extracting of the pre sprayed soiled surface areas.

6 Claims, 5 Drawing Sheets

SURFACE CLEANING WITH CONCURRENTLY USABLE PRESPRAY AND RINSE UNITS

CROSS-REFERENCE TO RELATED APPLICATIONS

This application is a divisional application of U.S. application Ser. No. 12/776,413, filed May 9, 2010 and entitled "Surface Cleaning with Concurrently Usable Prespray and Rinse Units", now pending, which is hereby incorporated by reference in its entirety as though fully set forth herein.

FIELD OF THE INVENTION

The present invention relates to an improved multi-functional cleaning machine and method, and particularly, to a multi-functional carpet, stone, tile, and furniture cleaning machine and method for cleaning surface areas in commercial, industrial, institutional, public, and residential buildings.

BACKGROUND

Maintaining the cleanliness of commercial, industrial, institutional, public, and residential buildings is an ongoing effort. Various cleaning machines have been devised to clean carpeted or tiled floors, stone floors, furniture and the like.

A common way of cleaning soiled surfaces is by extracting the dirty matter from a soiled surface. As disclosed in U.S. Pat. No. 3,883,301, issued to Emrick et al., a cleaning head 15 is used to spray a detergent solution on areas of textile fabric, such as carpet, upholstery and the like, and to vacuum the solution and soil from the sprayed areas.

However, as disclosed in U.S. Pat. No. 4,154,578, issued to Bane, some of the detergent solution sprayed on a carpeted surface is left with the carpet fibers even after the surface is vacuumed with an extractor wand. This is because the detergent solution used to wash carpets is alkaline, while dirt is generally acidic. As a result, dirt is attracted to the alkaline residue left on the carpet. The alkalinity remaining with the carpet fiber greatly accelerates and increases the rate of resoiling of the carpet. To solve this problem, Bane further sprays the carpet with an acid solution to neutralize the alkaline residue left on the carpet and then vacuums the acid solution from the carpet.

U.S. Pat. No. 6,880,191, issued to Bristor, discloses an extraction cleaning system that uses a spray gun and an extraction wand or tool. The spray gun is used to apply a prespray to a carpet. The prespray is allowed to dwell on the carpet for 5-15 minutes. After the dwell time has elapsed, the extraction wand is used to apply a rinsing agent to the carpet, and to extract the rinsing agent from the carpet.

In particular, Bristor discloses a container 11 for carrying prespray chemicals and rinse agents. In preparation for applying the prespray, Bristor connects a draw tube 64 to a supply tube 90a extending into a prespray supply jar 76a, and attaches a spray gun 100 to the distal end of a delivery hose (see FIG. 8). The diluted prespray is sprayed on an area of the carpet. The prespray is permitted to dwell on the pre sprayed area for 5-15 minutes. Next, the draw tube 64 is switched from the supply tube 90a to a supply tube 90b. The second supply tube 90b extends into a supply jar 76b containing a rinse agent. In addition, the spray gun 100 is replaced with an extraction wand 114. After the dwell time has elapsed, the diluted rinse agent is sprayed on the pre sprayed area of carpet and extracted with the wand 114 (see FIG. 9). This cycle is repeated, area-by-area throughout the cleaning site 14 until the job is completed.

A shortcoming with Bristor's cleaning operation is the time that a worker spends in repeatedly switching between supply jars and repeatedly switching between the spray gun and the extractor wand. Bristor's operation would be more efficient if the series of starts and stops could be eliminated. Bristor does not allow areas of carpet to be pre sprayed while areas of pre sprayed carpet are being rinsed. In Bristor, anytime a carpet area is being rinsed, another area of carpet cannot be pre sprayed, and anytime a soiled carpet is being pre sprayed, another area of pre sprayed carpet cannot be rinsed. The step of rinsing cannot be performed at the same time as another area of pre sprayed carpet is being rinsed. The cleaning process has to stop whenever the spray gun and extraction wand have to be swapped, and whenever the supply jars have to be swapped. It would be more efficient if the switching between different jars of cleaning agents could be eliminated. Also, it would be more efficient if the switching between the spray gun and the extractor wand could be eliminated. Elimination of the time directed to all this switching would result in a more efficient process.

Another problem with cleaning machines, which use extraction wands, or tools, is the time consumed in moving various hoses to the cleaning site. At times, the hoses and cords get tangled and have to be sorted out thereby wasting time that could be used in a more beneficial manner. For example, Bane shows a mobile carpet-cleaning unit 11 that includes several reels, 16 through 19, which are suspended on a rod 22 and contain various lengths and types of hoses required to clean carpets. These hoses have to be unwound from the reels and each end of each hose has to be attached properly. It would be more efficient if some of the hoses could brought to a cleaning site with one end of each hose already connected to the components that make up cleaning apparatus.

SUMMARY OF THE INVENTION

Accordingly, the present invention has an object, among others, to overcome deficiencies in the prior art, such as noted above.

The present invention provides an integrated, multi-functional, surface-cleaning apparatus, suitable for use in the field of carpet, tile, stone, and furniture cleaning. To this end, and in accordance with the principles of the invention, one aspect of the invention is an improved carpet-cleaning method and apparatus.

The improved carpet-cleaning apparatus includes a prespray unit and a rinse unit. Each of the units is provided with water from a water service line at the cleaning site. The prespray unit includes a water-driven proportional pump for mixing a prespray with the water from the service line to provide a diluted prespray. The diluted prespray is delivered to a spray gun and sprayed on areas of the carpet.

The rinse unit includes a motor-driven triplex pump for increasing the pressure of the water from the service line. Also, a chemical injector is included for mixing a rinse agent with the pressurized water to provide a diluted rinse agent. The rinse unit includes a bypass line that allows the water from the triplex pump to bypass the chemical injector to provide a water only rinse. The diluted rinse agent or water only is delivered to an extraction wand and sprayed on pre sprayed areas of the carpet and immediately extracted using the extractor wand connected to an extraction system.

The present invention is unlike the prior art extraction cleaners that require the spray gun and the extractor wand to be switched during the cleaning process. In the present invention, the spray gun can be used concurrently with the extraction wand.

Another aspect of the cleaning apparatus is the inclusion of an additional extraction wand or tool and an additional extraction system to reduce the time expended in rinsing and extracting pre sprayed areas of carpet.

Another aspect of the instant cleaning machine is its mobility. All the components of the instant cleaning machine can be moved to a cleaning site at the same time. Most of components are mounted on a four-wheeled platform cart. The extraction wands, extractor hoses and the solution hoses can be placed on top of the components. One extractor hose is bundled with one solution hose. The cart allows all the components of the cleaning machine to be moved to, around, and from the cleaning sites at a commercial, industrial, institutional, public, or residential building. Moreover, this arrangement allows easy access to the components during the operation and maintenance of the machine.

Another aspect of the present invention has to do with the inclusion of a pair of reels on the four-wheeled platform cart. One of the reels is a dual hose reel that is used to carry a pair of long hoses and a pair of long extension cords to the job site. The other reel is a single hose that is used to carry the spray gun and spray gun hose. The dual hose reel allows fluids to pass through the reel between the hoses on the reel and the components mounted on the platform cart. Also, the dual hose reel has a passage that allows the extension cords to pass through the drum of the dual hose reel. An end of one of the hoses is connectable to the water line of the water service of the building housing the areas to be cleaned. An end of the other hose is run to a dirty solution disposal site. One end of each of the extension cords is connectable to the power service at the cleaning site.

Another aspect of the present invention is its use as a multi-functional cleaning apparatus. In particular, a myriad of different cleaning extraction wands or tools can be used with the instant cleaning apparatus for cleaning different types of soiled surfaces.

Some of the potential features and advantages included in at least some of the embodiments of this invention, by way of example and without limitations, include an improved cleaning method and apparatus that is able to clean more than one surface at a time, provides mobility of the cleaning apparatus, enhances the usefulness of the cleaning apparatus, is capable of spraying different cleaning solutions at the same time, reduces the costs associated with cleaning surfaces of a building, is of relatively simple design, is economical in manufacture and assembly, and reduces the harmful risks involved with cleaning such surfaces.

DETAILED DESCRIPTION OF THE INVENTION

The present invention is hereinafter described with reference to the accompanying drawings, in which the preferred embodiment of the invention is shown. This invention may be embodied in many different forms and should not be construed as limited to the preferred embodiment set forth herein. Rather, the preferred embodiment is provided by way of example so that this disclosure will satisfy applicable legal requirements. Like numbers refer to like elements throughout.

Figure 1:
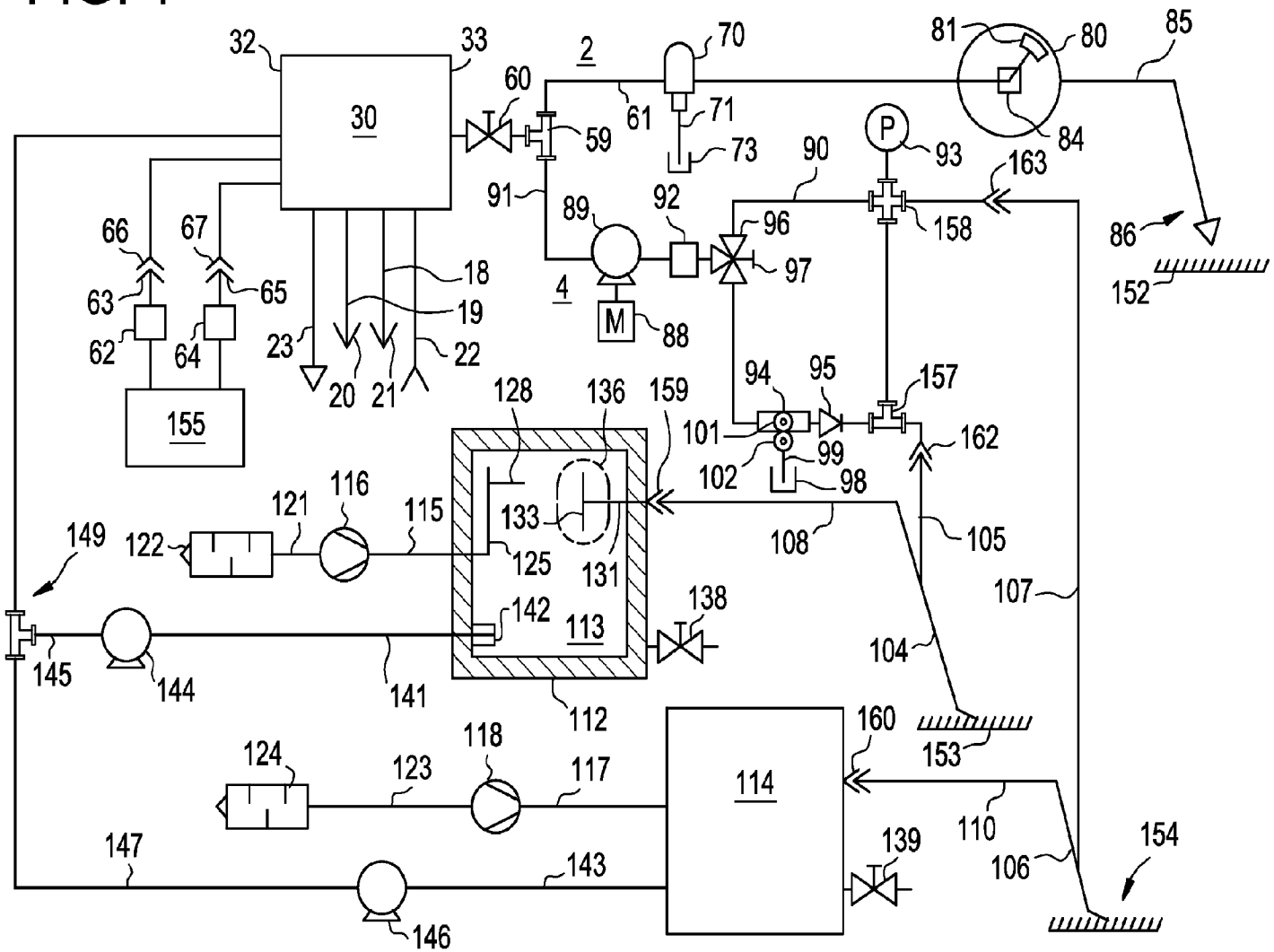
FIG. 1 is a schematic flow diagram of the present invention.

FIG. 1 shows a schematic flow diagram of the present invention. A water delivery hose 22 is connectable to a water line of the water service at the cleaning site. The hose 22 delivers water through a dual hose reel 30. From the dual hose reel, a first T-fitting 59 splits the water between a prespray unit 2 and a rinse unit 4. The prespray unit is a low-pressure unit and the rinse unit is a high-pressure unit. The function of the low-pressure unit 2 is to provide a diluted prespray for application on areas of soiled carpet. The function of the high-pressure unit 4 is to provide a diluted rinse agent, or a water only rinse, for application on pre sprayed areas of the soiled carpet.

In the prespray unit 2, water flows through a water hose 61 into a proportional pump 70. The proportional pump 70 siphons a prespray from a container 73 through a supply tube 71, and mixes the prespray with water to generate a diluted prespray. From the outlet of the proportional pump 70, the diluted prespray flows through a spray gun hose 85 on a single hose reel 80 to a spray gun 86. The single hose reel 80 has a right angle swivel fluid coupler 84 attached to an end of the single hose reel's axle. The coupler provides a fluid path between the outlet of the proportional pump 70 and an end of the spray gun hose 85. The function of the spray gun 86 is to apply a diluted prespray to areas of soiled carpet. Normally, the diluted prespray is allowed to dwell on the carpet for a suitable dwell time to help loosen the dirt and soil hidden deep within the carpet to emulsify the grease, oils soaps, etc.

The rinse unit 4 includes a motor 88 driven triplex pump 89 and a pressure-regulating unloader 92. Water flows from the water service line to the triplex pump 89 and is discharged from the unloader 92. The pressure of incoming service line water pressure is increased by setting and adjusting the pressure-regulating unloader 92 until the desired system pressure is attained to rinse the pre sprayed areas of carpet.

From the unloader 92, the water flows through a 3-port ball valve 96 to either a chemical injector 94, or to an injector bypass line 90. The chemical injector 94 provides a diluted rinse agent, while the bypass line 90 provides a water only rinse.

The ball valve has a control member 97 for directing the water to either the chemical injector 94 or to the bypass line 90. Specifically, when the control member 97 of the ball valve is turned in one direction, water from the pump 89 is allowed to flow to the chemical injector 94. Conversely, when the control member 97 is turned in the reverse direction, water from the pump 89 is allowed to flow to the bypass line 90. Water flowing to the chemical injector 94 draws a rinse agent from a container 98 through a supply tube 99, mixes the rinse agent with the pressurized water, and delivers a diluted rinse agent through a pair of rinse hoses 105 and 107 to a pair of extraction wands or tools 104 and 106. Conversely, water flowing to the bypass line 90 is sent directly through the pair of rinse hoses 105 and 107 to the pair of extraction wands or tools 104 and 106 as a water only rinse. In the preferred embodiment, the extraction wands or tools are, for example and without limitations, glide carpet tools, Part No. 10088A, manufactured by CFR, a Tacony Corporation, Fort Worth, Tex.

A check valve 95, a T-fitting 157, a cross-fitting 158, and a pair of self-sealing quick-disconnect couplers 162 and 163 permit the water rinse only and the diluted rinse agent to flow in the appropriate directions.

In particular, when the control member 97 is turned to permit the flow of water to the chemical injector 94, the diluted rinse agent is allowed to flow from the chemical injector, into the T-fitting 162, and out of an opening in the T-fitting 157 to the coupler 162. At the same time, the diluted rinse agent is allowed to flow out of another opening in the T-fitting 157, into the cross-fitting 158, and out of an opening in the cross-fitting 158 to the coupler 163.

Further, when the control member 97 is turned to permit the flow of water to the bypass line 90, a water only rinse is allowed to flow from the bypass line 90, into the cross-fitting 158, and out of an opening in the cross-fitting to the coupler 163. At the same time, the water only rinse is allowed to flow out of another opening in the cross-fitting 158, into the T-fitting 157, and out of an opening in the T-fitting 157 to the coupler 162. The check valve 95 prevents the water only rinse from flowing back into the chemical injector 94 from an opening in the T-fitting 157. Each of the rinse hoses 105 and 107 has a coupler at one end for connecting the rinse hoses 105 and 107 to the mating couplers 162 and 163, respectively.

A pressure gauge 93 is coupled to an opening in the cross-fitting 158 to indicate the pressure of the rinse fluid.

As further depicted in FIG. 1, the rinse hose 105 is connected to an extraction wand 104. The rinse hose 107 is connected to another extraction wand 106. Each of the extraction wands includes a nozzle arrangement (not shown) for applying the diluted rinse agent, or a water only rinse, on pre sprayed areas of the carpet 153 and 154.

As the diluted rinse agent, or the water only rinse, is applied to the pre sprayed areas of carpet, the prespray and loosened dirt are quickly extracted from the carpet through extractor hoses coupled to a pair of extraction systems. The extraction systems include a dirty solution tank assembly 100 (FIGS. 2 and 3) having two dirty solution tanks 112 and 114. Each of the tanks 112 and 114 is connected to a respective one of the vacuum motors 116 and 118 by vacuum lines 115 and 117. The vacuum motor 116 is vented to the atmosphere by an exhaust line 121 connected to a muffler 122. The vacuum motor 118 is vented to the atmosphere by an exhaust line 123 connected to a muffler 124. Further, each of the extraction wands 104 and 106 is connected to a respective one of the extractor hoses 108 and 110 and vacuum-pick up head (not shown). Each of the extractor hoses 108 and 110 has a coupler at one end for connecting the extractor hoses 108 and 110 to the mating couplers 159 and 160, respectively. Further, each tank is provided with a manually operated drain valve 138 and 139.

When the chamber 113 of the tank 112 is subjected to vacuum pressure from the vacuum motor 116, a suction force extends through the extractor hose 108, the extraction wand 104 wand and the wand's vacuum pick up head to extract a dirty solution comprising the diluted prespray and the diluted rinse agent sprayed on the carpet along with the loosened dirt entrained in the carpet, all of which is deposited in the dirty solution tank 112. The extractor hose 108 is coupled to the outside of the wall of the tank 112 near the top of a vertical wall of the tank. Inside the chamber 113 of the tank 112, a dirty fluid pipe 131 is coupled to the extractor hose 110 through a wall of the tank 114. The dirty fluid pipe 131 extends into the chamber in a horizontal fashion. The end of the pipe 131 has a reducing T-section 133 that allows the dirty solution to flow out the bottom end and air to flow out the top end. A net 136 covers the T-section to catch any large particles of dirt in the dirty water. Further, inside the chamber 113 of the tank 112, a riser pipe 125 extends into the chamber at a right angle to a wall of the chamber 113. The riser pipe 125 includes a horizontally mounted liquid-level float-switch 128, which is electrically connected to a relay (not shown) that is operatively connected to a respective vacuum motor 116 to prevent the vacuum motor from being damaged by the dirty solution. The riser pipe 125 is mounted in the mid-portion of the wall of the tank 112. In operation, the float-switch 128 and relay function to actuate and de-actuate the vacuum motor 116. The extraction wand 106, extractor hose 110, vacuum hose 117, vacuum motor 118 and muffler 124 operate in the same manner to extract a dirty solution from the carpet 154 into the dirty solution tank 114.

In the preferred embodiment, two discharge pumps 144 and 146 are used to pump out the dirty solutions from the dirty solution tanks 112 and 114. Each of the tanks 112 and 114 is connected to a respective one of the discharge pumps 144 and 146. A coupling 141 couples the input of discharge pump 144 to the dirty solution tank 112. Another coupling 143 couples the input of the discharge pump 146 to the solution tank 114. One end of a discharge hose 145 is connected to the output of the discharge pump 144. One end of a discharge hose 147 is connected to the output of the discharge pump 146. Inside the chamber 113 of the tank 112, a filter 142 is coupled through the wall of the tank 112 to the coupling 141. A similar filter is included in the chamber of the tank 114. Each of the discharge hoses 145 and 147 is connected to a fitting 149 in fluid communication with the dual hose reel 30. In FIG. 1, the fitting 149 is depicted as a T-fitting. However, a Y-fitting could be substituted for the T-fitting if desired. The return hose 23 is connected to the dual hose reel in fluid communication with the T-fitting 149. In operation, the discharge pumps 144 and 146 pump dirty solutions from the solution tanks 112 and 114 through the dual hose reel 30 to a return hose 23 that is connectable to a discharge site, for example, a preexisting commercial drain, sewer line, commode or holding tank.

As viewed in FIGS. 2 and 3, most of the components of the present invention mounted on or below a platform 13 of a four-wheel platform cart 12, The platform cart 12 is generally of conventional construction and includes the platform 13, a tubular handle 16, and a toe plate 17. In operation, the portable cart provides a portable unit, which can be wheeled to a cleaning site. (It is noted that in this description, the handle 16 is considered as being situated at the rear of the cart and the toe plate 17 as being in the front of the cart.) All of the components needed to clean a carpeted surface are mounted on the platform of the cart with the exception of the extraction wands, the rinse hoses, the extractor hoses for the extraction wands, and the containers of pre spray and rinse agent. Some of the components mounted on the top of the platform 13 are: a dual hose reel 30, a motor 88, a triplex pump 89, a chemical injector 96, a dirty solution tank assembly 100, a single hose reel 80 with a proportional pump 70 attached thereto, and two discharge pumps 144 and 146. Two vacuum motors 116 and 118 (not visible) with relays (not visible), two mufflers 122 and 123, and an electrical wiring assembly 155 (not visible) are mounted to the bottom of the platform 13.

The dual hose reel 30 is preferably a reel, with one modification, produced by Cox Reels, Tempe, Ariz., and identified as Series 1275-4-100. The dual hose reel 30 is mounted at the front of the cart behind the toe plate 17. As depicted in FIGS. 3 and 4, the reel produced by Cox Reels was modified to include two holes (not visible) in the side 32 of the reel 30. The holes allow an end of each extension cord 18 and 19 to pass through the opening 38 of the drum 34 and out the side 32 of the reel. As depicted in FIG. 2, the reel 30 includes a gear arrangement 37 for turning the reel 30 with a hand-crank (not shown).

In addition, the dual hose reel 30 includes a horizontally disposed axle 42 extending transversely of a reel support frame 36. The axle is hollow except for a wall (not visible) that forms two open-ended chambers (not visible) in the interior of the axle. The chamber located in the left side of the axle is open at the left end of the axle. The chamber located in the right side of the axle is open at the right end of the axle. The axle 42 includes a central portion and two end bearing portions that extend through bearing blocks 44 and 45 to support the axle horizontally for rotation. Spaced opposed, right and left circular discs 32 and 33, respectively, concentric with the axle, are secured to the central portion of the axle. A drum 34 concentric with and spaced from the axle extends between the discs 32 and 33 and has its lateral extremities secured to the interior surfaces of the left and right discs 32 and 33. The delivery and return hoses 22 and 23, respectively, are supported on the reel 30 and may be wound and unwound concurrently there from. So that water may be directed from the delivery hose 22 through the reel 30, the central portion of the axle is provided with a right angle hose connector 46 that extends through an opening 38 in the drum 34. The hose connector 46 is in fluid communication with the chamber formed in the left side of the axle. A right angle swivel fluid coupling 51 is connected to the left end of the axle. The combination of the hose connector 46, the chamber in the left side of the axle, and the swivel 51 form a first fluid conduit through the left side of the axle. With the delivery hose 22 connected to the hose connector 46, water flowing through the delivery hose 22 is directed through the first conduit, through a water shutoff valve 60, through a T-fitting 59, which splits the water flow to the proportional pump 70 via the hose 91 and to the triplex pump 89 via the hose 61. A similar conduit is formed on the right side of the reel. Specifically, so that a dirty solution may be directed to the return hose 23 through the dual hose reel 30, the central portion of the axle is provided with another right angle hose connector 48 that extends through the opening 38 in the drum 34. The second connector is in fluid communication with the chamber formed in the right side of the axle. Another right angle swivel fluid coupling 52 is connected to the right end of the axle. A T-fitting 149 (or Y-fitting) is connected to the swivel coupling 52 for connecting the discharge hoses 145 and 147 to the dual hose reel 30. The combination of the hose connector 48, the chamber in the right side of the axle, the swivel 52, and the T-fitting 149 form a second fluid conduit through the right side of the axle. With the return hose 23 connected to the hose connector 48, a dirty solution flowing from the discharge pump 144 via the discharge hose 145, and from the discharge pump 146 via the discharge hose 147, is directed through the T-fitting 149, through the chamber in the right side of the axle, and out to a discharge site.

A sheath (not shown) encloses the delivery hose 22, the return hose 23, and two extension cords 18 and 19, is coiled on the dual hose reel 30, when the cleaning machine is not in use. As viewed in FIG. 4, the hoses 22 and 23 and the cords 18 and 19 are unwound from the second reel. The sheath functions to organize the hoses and cords into a single neat and tidy bundle that is conveniently wound and unwound and that prevents the hoses and cords from getting tangled. The length of each hose and each cord is approximately 100 feet or 30 meters in length.

The extension cords 18 and 19 provide electricity to the electrical components mounted on the platform 13. Each extension cord is connectable to the electrical service at the cleaning site. The opposite end of each extension cord includes an electrical socket 66 and 67. As pointed out above, the dual hose reel 30 has two holes 54, which provide access to the inside of the drum 34. The holes 54 allow the sockets on the extension cords to pass through the drum 34 and out the side 32 of the reel 30. This feature allows the extension cords 18 and 19 to be wound on the dual hose reel 30 with the sockets 66 and 67 located within the drum 34 of the dual hose reel.

Two ground fault circuit interrupters 62 and 64 are mounted on the dual reel support frame 36. Each interrupter has a plug 63 and 65. One interrupter plug 63 is connectable to the socket 66 of the electrical cord. The other interrupter plug 65 is connectable to the other socket 67 of the other electrical cord. In FIG. 1, opposed ends of the interrupters 62 and 64, respectively, are depicted as connected to the wiring assembly 155.

Accordingly, the hoses 22 and 23 and the extension cords 18 and 19 do not have to be dragged to and around the work site. When not in use, the hoses and cords are neatly stored around the drum 34 of the dual hose reel 30. When the four-wheeled cart is rolled to a job area, the sheath of hoses and cords is simply unwound and each hose and cord is connected to the appropriate source of water, disposal site, and power, respectively. When a carpet site has been cleaned, the hoses and cords are disconnected from the site's water and power services, rewound on the dual hose reel and the cart is moved to another cleaning site, returned to its original location. This feature of the present invention provides the advantage of not having to drag the hoses and cords when moving to, between, or from different locations.

Further, another aspect of the present invention is that when the hoses and cords are uncoiled, a cavity 35 (see FIG. 4) is created between the drum 34 of the dual hose reel 30 and the toe plate 17 of the platform cart. The cavity provides a temporary storage place for the prespray container 73 and the rinse agent 98.

Figure 5:
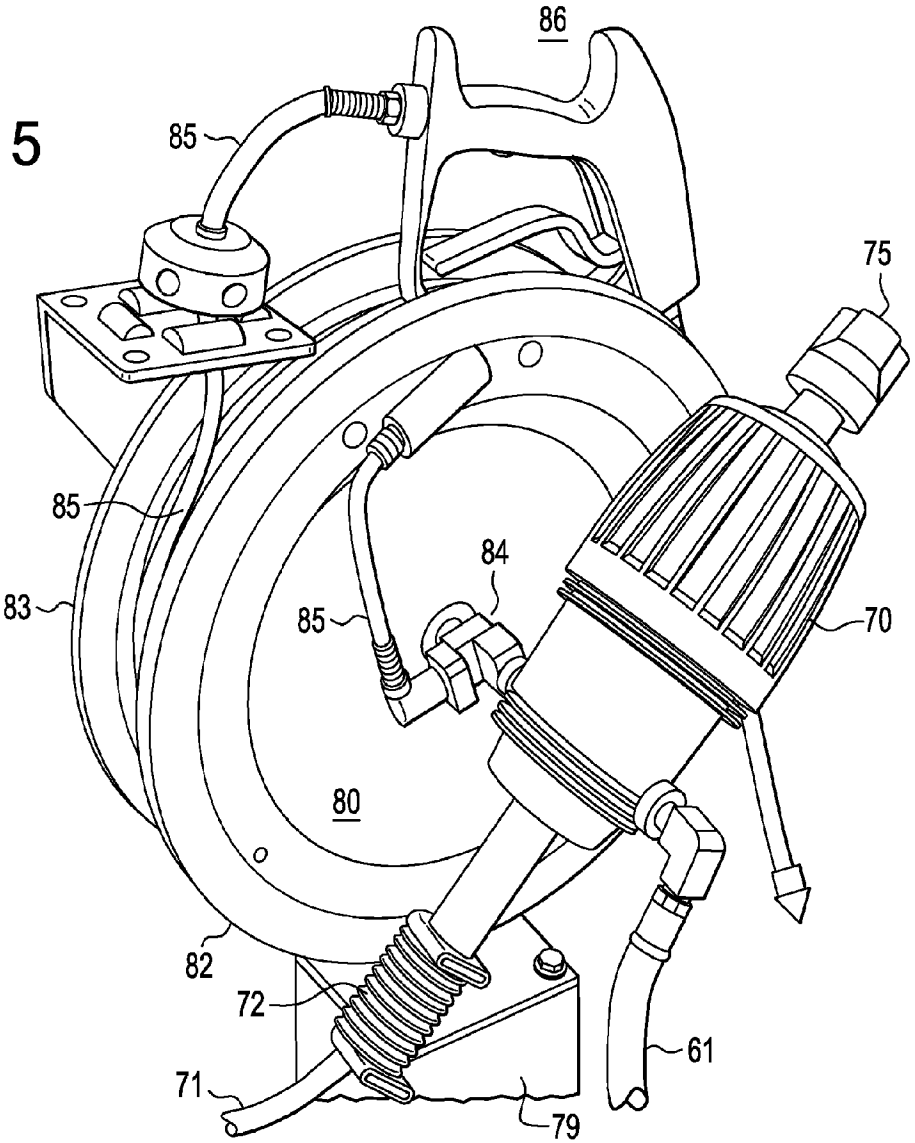
FIG. 5 is a perspective view of the single hose reel of the present invention.

The other reel mounted on the platform cart 12 is preferably a self-retracting single hose reel 80 produced by Cox Reels, and identified as Series PLP-500 AL. As shown in FIGS. 2, 3 and 5, the self-retracting single hose reel 80 carries the proportional pump 70, the spray gun hose 85, and the spray gun 86. The single hose reel 80 is mounted on a reel support frame 79. The spray gun hose 85 is supported on the reel 80 and may be wound and unwound on the axle of the reel. The length of the spray gun hose is approximately 50 feet or 15 meters in length.

In particular, the single hose reel has spaced opposed, right and left circular discs 83 and 82, respectively, concentric with the axle, which discs are secured to the axle of the reel. The left circular disc 82 has an opening 81. A right angle swivel fluid coupling 84 is mounted on an end of the axle of the single hose reel 80. The distal end of the spray gun hose passes through the opening in the left circular disc 82 and is connected to a port of the swivel 84. The outlet of the proportional pump is connected to another port of the swivel 84. The swivel 84 allows the prespray to flow from the proportional pump 70 through the spray gun hose 85 to the spray gun 86. Accordingly, the spray gun hose does not have to be dragged or carried to a cleaning site. Moreover at the cleaning site, the hose can be wound and unwound as needed.

The proportional pump 70 is preferably a pump produced by Dema Engineering Company, St. Louis, Mo., and identified as Model No. 573. Water flow through the pump housing serves as a power source that drives a master piston to reciprocate up and down while a smaller chemical suction piston, which is attached to the master piston, follows to draw a measured amount of chemical cleaning agent into the suction section of the pump and releases the chemical into the water stream of the pump with each return stroke of the master piston. No electricity is required. The master piston reciprocates in direct proportion to the flow of water through the pump housing; the larger the flow rate, the quicker the master piston operates the suction piston. The flow rate range is 0.09 to 11 gallons per minute. The amount of chemical drawn on each return stroke is regulated by a proportioning adjuster, which lengthens or shortens the chemical reservoir that the chemical piston plunges into on each intake stroke. The proportioning adjuster 72 has a percent scale (not shown) on one side and a ratio scale (not shown) on the other and is set by turning the adjuster clockwise or counterclockwise to match up with the desired scale. Turning the proportioning adjuster clockwise increases the amount of chemical additive. Turning the proportioning adjuster counter clockwise decreases the amount of chemical additive. An on/off valve 75 controls the pumping action of the proportional pump. When valve is turned on, the pump is turned on to draw the chemical into the proportional pump. In the off-position, the pump is prevented from drawing the chemical. The operating pressure of the water is 2.9 to 85 pounds per square inch. The injection ratio of Model 573 is from 250:1 to 25:1 or 0.4% to 4% ounces per gallon.

Figure 2:
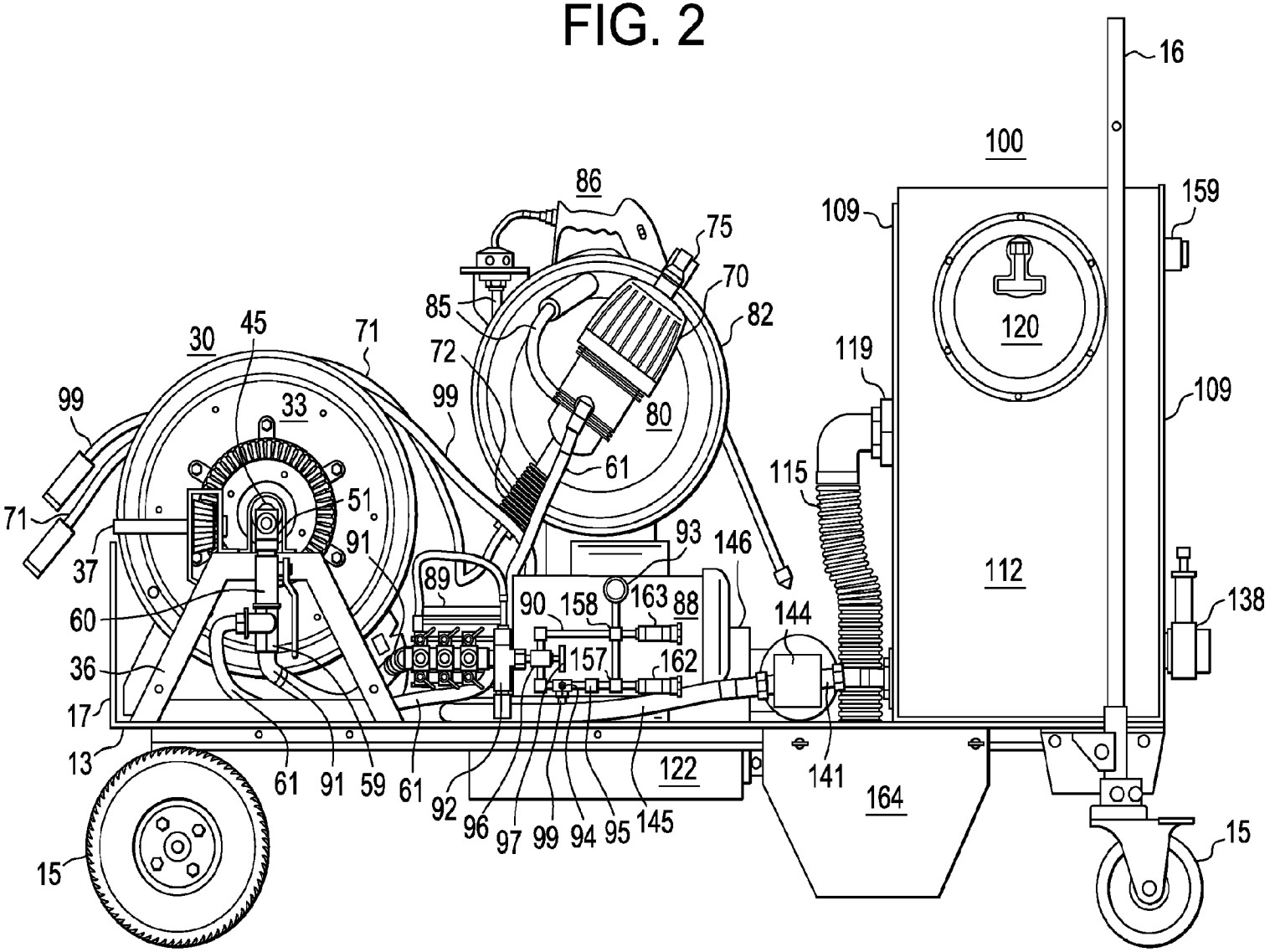
FIG. 2 is a left side perspective view of the present invention.

As shown in FIG. 2, other components mounted on the platform 13 include the motor 88 and the pump 89 in operable communication with one another, the pressure-regulating unloader 92, the ball valve 96, the bypass line 90, the chemical injector 94, the check valve 95, the pressure gauge 93, the cross-fitting 158, the T-fitting 157, and the couplers 162 and 163. In the preferred embodiment, the pump 89 is, for example and without limitations, a triplex design, direct-drive plunger pump manufactured by Cat Pumps, Minneapolis, Minn., Model No. 2SF22ELS. The pump 89 can deliver up to 1500 psi at 2.2 gallons per minute. The unloader 92 is used to set the pressure of the water discharged by the triplex pump. A pressure gauge 93 is included for indicating the pressure of the water.

In the preferred embodiment, the chemical injector 94 is preferably manufactured by Dema Engineering Company, St. Louis, Mo., and identified as Model No. 202 B. Inline chemical injectors function to inject fluids into lines conveying liquid under pressure. In this instance, the injector is a jet pump. The liquid under pressure, usually water, enters a nozzle at the inlet of the chemical injector and accelerates into a jet through the nozzle. This high velocity jet creates a vacuum, which causes fluid to be drawn through a supply tube and into the injector. The mixture of water and fluid then flows into a diverging (venturi) passage. In effect, the fluid is drawn into the water line.

The chemical injector 94 has a water flow adjusting or bypass screw 101 and a fine metering adjustment screw 102. To actuate the injector, the water flow adjusting or bypass screw is turned clockwise until the rinse agent begins to draw from the container 98. After the rinse agent reaches the injector, the feed rate may be adjusted to the desired rate by turning the water flow adjusting screw. For low injection rates, the water flow adjusting screw is set for more injection than required; then the fine metering screw is turned clockwise to reduce the injection rate to the desired rate. If the metering screw is clockwise to the place where it will not turn anymore, no rinse agent will be injected.

Figure 3:
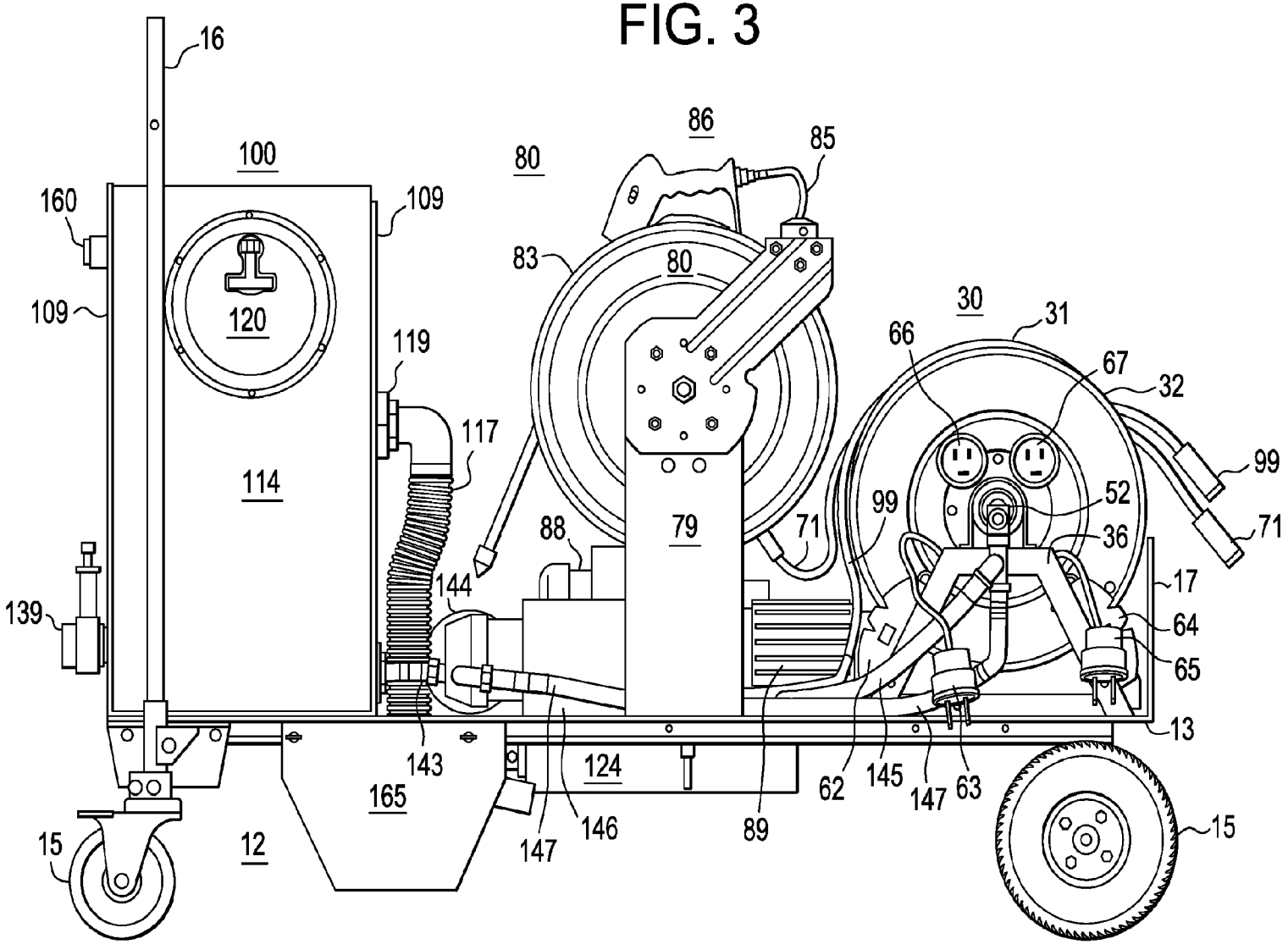
FIG. 3 is a right side perspective view of the present invention.
Figure 4:
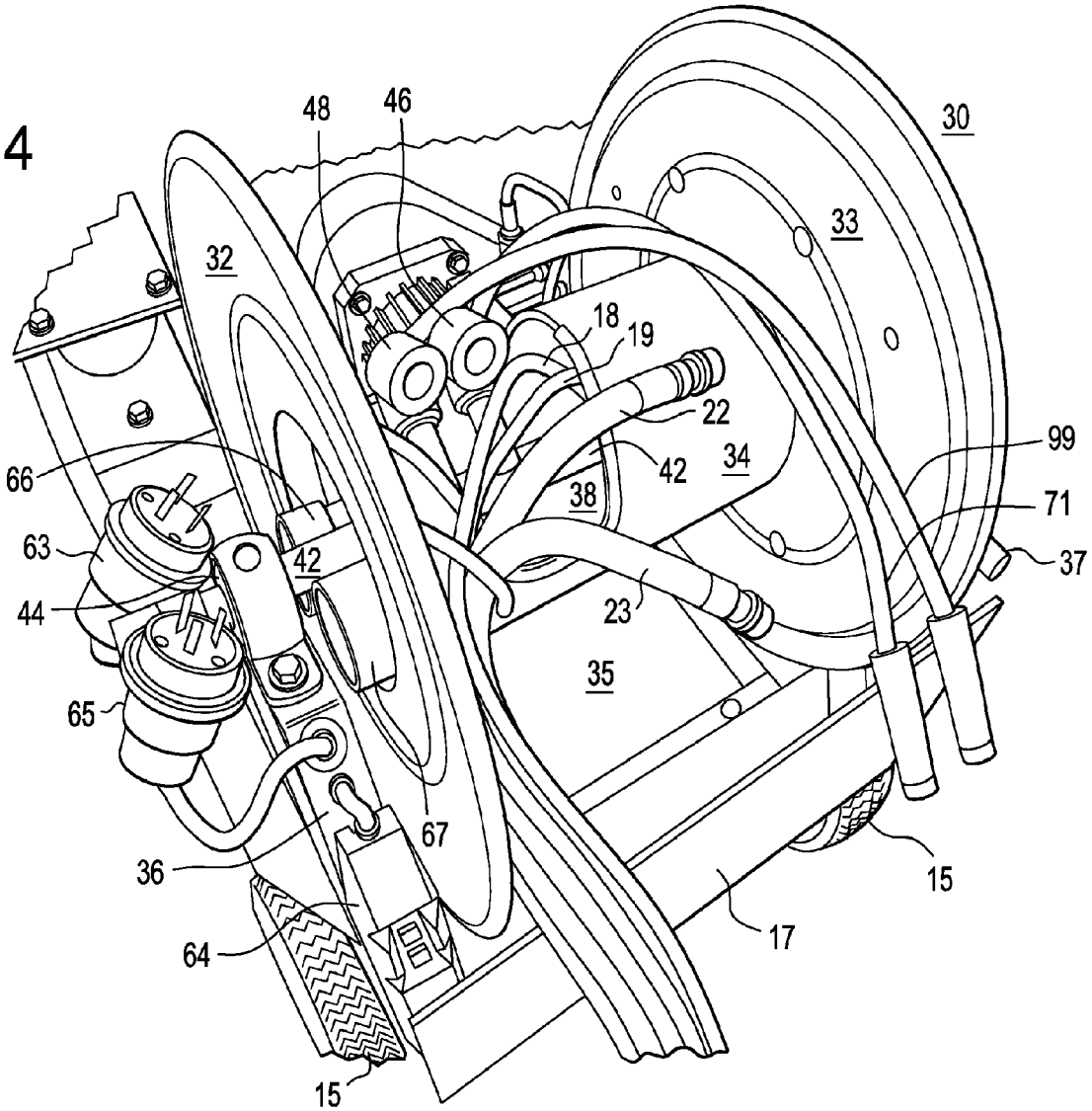
FIG. 4 is a perspective view of the dual hose reel of the present invention.

Further, as shown in FIGS. 2 and 3, other components mounted on the platform cart 12 include the dirty solution tanks 112 and 114, the vacuum motors 116 and 118 (not visible), the mufflers 122 and 124, and the discharge pumps 144 and 146.

In the preferred embodiment, the dirty solution tanks 112 and 114 are mounted side-by-side within a U-shaped metal housing 109 on top of the platform 13. Each of the tanks is provided with an access port and access cover 120. Bulkhead fittings 119 are used to ensure that the connections through the walls of the tanks are watertight and airtight. In the preferred embodiment, the liquid-level float-switch 128 is, for example and without limitations, Model No. M8700, manufactured by the Madison Company, Branford, Conn. In the preferred embodiment, the solid-state relay is, for example and without limitations, Model No. SNC-R2025-511, manufactured by Ametek National Controls Corporation, West Chicago, Ill. In the preferred embodiment, the filter 142 is, for example and without limitations, manufactured by Flow Ezy Filters, Inc., Ann Arbor, Mich.

In the preferred embodiment, the vacuum motors 116 and 118 (not shown) are mounted on the bottom of the platform 13 and are, for example and without limitations, manufactured by Ametek.

In the preferred embodiment, the mufflers 122 and 124 (not shown) are mounted on the bottom of the platform 13 are, for example and without limitations, Vaculine™ Model No. 765500, manufactured by Canaplas Industries Ltd, Barrie, Ontario, Canada.

In the preferred embodiment, discharge pumps 144 and 146 are, for example and without limitations, manufactured by Flojet, Foothill Ranch, Calif. Each discharge pump has a switch (not shown) to actuate and de-actuate the pump.

The following describes an example of how the preferred embodiment, illustrated in the accompanying figures and/or described above, is used by three workers to clean carpets in a hotel. In this example, the guest rooms are situated on either side of a corridor, which is approximately 200 feet in length.

The platform cart is rolled to the middle of the corridor. There, the first worker goes to the dual hose reel and holds onto the end of the sheath covering the bundle of hoses and cords on the dual hose reel. At the same time the second worker pulls the cart toward one end of the corridor near the door of the last room located at this end of the corridor. The cleaning process begins at this end of the hallway. As the cleaning process progresses, the cart will be pushed toward the opposite end of the corridor, stopping near each guest room door until the opposite end of the corridor is reached.

The first worker walks into the nearest guestroom with the end of the bundle. There the first worker proceeds to connect the delivery hose in the bundle to the source of hot water under the bathroom sink by: shutting off the valve connected between the hot water line coming out of the wall and the water-supply tube running to the sink faucet; disconnecting the water-supply tube from valve; connecting one end of an adapter hose to the valve; connecting the other end of the adapter hose to the delivery hose; and turning the valve back on, thereby providing hot water at around 80 psi to the prespray and rinse units on the cart. Next, the first worker takes the end of the return hose in the bundle and places it inside the bathroom commode.

While the first worker is connecting the delivery and return hoses, the second worker has been preparing the cart. In particular, the second worker would have placed the prespray and rinse agent containers in the cavity between the toe plate and the drum. Also, the second worker should have connected each circuit interrupter plug to a respective extension cord socket protruding from the end of the dual hose reel. After this, the second worker prepares the prespray and rinse units by: placing the prespray supply tube in the prespray container, placing the rinse agent supply tube in the rinse agent container, and unwinding the spray gun hose and priming the spray gun nozzle. The proportioning adjuster is adjusted to a flow rate appropriate for the surface being cleaned. In this example, the flow rate is set at around 1:33 to 1:22 depending on the appearance of the carpets. The spray gun is ready for pre spraying the carpets.

After finishing with the delivery and return hoses, the first worker assists the second worker in coupling the rinse hoses to the couplers on the T-fitting and the cross-fitting, and in connecting the extractor hoses to the dirty solution tanks. Then the control member on the ball valve is turned to allow water to flow into the chemical injector and the unloader is adjusted to provide an operating pressure of around 250 to 300 psi. Then, all the fluid hoses and fluid connections are checked for leaks.

Next, the machine's motor driven triplex pump, the vacuum motors and the discharge pumps are connected to a source of electricity. This is accomplished by: identifying two 20-amp outlets in and near the room in which the delivery hose is connected to the water service line. Usually, the receptacles in a room are not on the same circuit as the receptacles in the hallway. Hence, the first worker will plug one of the extension cords into a receptacle in the room and the other extension cord into a receptacle in the hallway. Then, the second worker will turn on the ground fault circuit connectors and test the operability of the electrical components. It should be recognized that the electrical compatibility of the power available at a cleaning site and the power requirements of the machine would have been checked out prior to bringing the machine to the cleaning site.

While the first and second workers have been preparing the machine, the third worker has been preparing the guest rooms, starting with rooms at the end of the hallway where the cart is located. For example, the third worker has been going from room to room, opening doors, making sure that there is sufficient light in each room, lifting any lightweight furniture off the floor, and rearranging furniture to provide paths for efficiently pre spraying and moving the extraction wands over the carpet.

After rooms in the vicinity of the cart have been prepared, the third worker takes the spray gun and starts pre spraying the rooms that have been prepared, as well as the portion of the hallway in back of the cart, which can be reached with the spray gun.

After the prespray has been on a carpet for about 10 to 15 minutes, the pre sprayed carpet is ready to be rinsed and extracted. The second and third workers prime the solution hoses, and adjust the chemical injector for the appropriate rinse, e.g., water or diluted rinse agent. They start with the areas of carpet that are most distant from the entry door. It may be that each worker will enter the same room or separate rooms, or one worker may rinse and extract the pre sprayed portion of the hallway. This depends on the arrangement of the entry doors and the size of the rooms along the corridor. For example, there may only be one, or as many as four rooms, that are reachable from the cart by the spray gun and extractor wands. As the first and second workers clean their way back toward an entry door, the first worker moves the cart toward the next entry door.

After pre spraying the rooms reachable by the spray gun, the third worker determines whether the cart may be moved. In order to pre spray another room, the spray gun must be able to reach inside the room. The first worker will move the cart when there is sufficient slack in the hoses attached to the extractor wands for the spray gun to pre spray the next room.

The third person is responsible for pushing the cart toward the opposite end of the hallway until all the guest rooms are pre sprayed and rinsed. At some point, the cart will pass by the water and electrical sources on its way to the last set of rooms at the opposite end of the hallway. If at anytime, after the cleaning process has started, the cart is not ready to be pushed to the next location, the third worker uses the time to prepare further guest rooms for cleaning, to return moved items to their original position in the cleaned rooms, or to insure that the hoses are not in the way of the first and second workers.

A significant improvement provided by the present invention over prior art extraction cleaning machines is the combination of a low-pressure line for operating a prespray unit and a high pressure line for operating a rinse unit. Both lines are connectable to the same source of water. The low-pressure line allows one worker to pre spray a soiled carpet with a spray gun. The high-pressure line allows another worker to rinse pre sprayed areas of carpet with an extractor wand. This combination allows both units to operate concurrently. In the Bristor patent (U.S. Pat. No. 6,880,191), a spray gun and an extraction wand cannot be used concurrently. The spray caddy provides only one fluid to one cleaning tool at a time. In the present invention, the spray gun has its own dedicated fluid line, and the extractor wand has its own dedicated fluid line. As a result, these cleaning tools are operable concurrently, and at different pressures. The present invention has the advantage of being more efficient in that the carpet or some other surface may be cleaned using both tools at the same time.

The preferred embodiment illustrated in the accompanying figures and/or described above is merely exemplary and is not meant to limit the scope of the invention. It is to be appreciated that numerous embodiments, and/or arrangements to the preferred embodiment have been contemplated as would be obvious to one of ordinary skill in the art with the benefit of this disclosure. All variations, arrangements, and/or modifications of the preferred embodiment that read upon the appended claims are intended and contemplated to be within the scope of the invention.

In particular, the preferred embodiment has been described as being for cleaning soiled carpeted or textured surfaces. In general, the pressure of the water used in rinsing carpeted and textured surfaces is between about 250 psi and about 500 psi. Other surfaces are rinsed with pressures below 250 psi and above 500 psi. In this instance, the preferred embodiment is a multi-functional cleaning machine, which has the capacity to clean a myriad of soiled surfaces other than carpeted surfaces. An intended function of the preferred embodiment, of cleaning different types of soiled surfaces is achievable by simply substituting the extraction tools 104 and 106 with alternate tools compatible with the surface to be cleaned, setting the water pressure pumped out of the triplex pump 89 to a pressure suitable for rinsing the surface to be cleaned, and setting the ball valve 96 to allow the surface to be rinsed with either a diluted rinse agent or a water only rinse.

For example, a process for cleaning hard surfaces, such as porcelain and ceramic tile with sanded grout lines, includes pre spraying soiled tile and grout with a diluted alkaline based prespray, letting the diluted prespray dwell up for approximately 15 minutes, and applying a water only rinse with pressures between about 800 psi and about 1500 psi to the pre sprayed tile and grout and immediately extracting the dirty solution from the tile and grout. An extraction tool for cleaning hard surfaces, such as tile and grout, is the Turbo Hybrid model manufactured by the Turbo Force International Company, Glendale, Ariz.

Another example relates to cleaning upholstered fabric, or fabric such as, curtains and the like. A process for cleaning fabrics includes pre spraying soiled fabric with a special solution designed for the fabric and soil condition for emulsifying the soil in the fabric, and extracting the soil with a gentle controlled water only rinse using a special extraction tool. The pressure of a water only rinse is generally about 100 psi. An extraction tool for cleaning upholstery, sheers, and general spotting is a combination hand tool, Part No. 10224A, manufactured by the CFR.

Other examples of alternate extraction wands or tools that can be substituted for the extraction wands 104 and 106 include a special purpose hand tool, CFR Part No. 10225A, for cleaning stairs, office panels, fabric wall coverings and other large flat fabric covered surfaces. Another company, Hydro-Force Manufacturing, Salt Lake City, Utah, manufactures tools, Models AR52 and AR 54, for cleaning counter tops, around toilets, and shower stalls.

Accordingly, as used herein and the appended claims, the preferred embodiment can be utilized to clean a variety of floor surfaces, including but not limited to carpets, rugs, ceramic tile, stone, vinyl, terrazzo, wood floors, and concrete surfaces. Additional surfaces that can be cleaned with the preferred embodiment include walls, counter tops, shower/bathroom surfaces, stairways, and upholstered furniture or fabric, such as curtains and the like. What all of the above surfaces have in common is that each surface is cleanable using a form of water extraction. Hence, although the couplers 159, 160, 162 and 163 are described as connectable to a CFR model extraction tool, any of a plurality tools are usable for use with the preferred embodiment to clean any of a myriad of soiled surfaces or fabrics. The preferred embodiment is capable of providing the requisite water pressure and type of rinse that is suitable to the surface or fabric intended to be cleaned, and is connectable to a tool appropriate to perform the rinsing and/or extracting functions.

Further, modifications to the preferred embodiment may also be practicable. One alternative embodiment of the cleaning machine is a smaller cleaning machine for use in cleaning surfaces in, for example, domestic residences. A smaller version of the preferred embodiment is connectable to only one wand and comprises all the components of the preferred embodiment mounted on a smaller platform cart, except for one of the extraction systems. In particular, the following components are eliminated: the dirty solution tank 114, the vacuum motor 118, the muffler 124, the discharge pump 146, and the hoses 115, 117, 121, 123, 145 and 147 used with these components. Further, the T-fitting 157 is replaced with an elbow fitting and the coupler 162 is eliminated.

Another alternative embodiment to the preferred embodiment is a cleaning machine for use in pre spraying different types of surfaces simultaneously with different diluted presprays. Such a machine could be formed by the inclusion of an additional prespray unit in parallel to the prespray unit in the preferred embodiment.

In another embodiment, the configuration of the cleaning machine can vary significantly and substantially. For instance, the vacuum motors and mufflers can be located on the top of the platform 13 mounted on a shelf protruding from the tank assembly 100 instead of to the bottom of the platform 13. Further, the specifications of the machine components, such as the motor and the triplex pump used in the rinse unit, can also vary.

Still further, it is contemplated that the extraction system 100 of the present invention can be operated independently of the prespray unit and rinse units of the preferred embodiment for extracting an excess amount of water caused by a burst water line, or some other water catastrophe.

Additional advantages and modifications will readily appear to those skilled in the art upon reading this Detailed Description. Therefore, the invention, in its broader aspects, is not limited to these specific details, representative apparatus and methods, and illustrative examples shown and described. It should be recognized that other components could be substituted for the particular model numbers identified above. Accordingly, departures may be made from such details without departing from the spirit or scope of the inventor's general inventive concept, which as described above, comprises a prespray unit applying a prespray on soiled surfaces at substantially the same time as a rinse unit is applying a rinse to pre sprayed soiled surfaces, wherein the inputs of both units are connected to a common source of water, and wherein the rinse unit is operated at a higher pressure than the prespray unit.

I claim:

1. A method for cleaning soiled surfaces, the method comprising:

supplying a stream of water from a water service line, the stream of water having substantially the same pressure as the water in the water service line;

directing the stream of water from the service line into a first flow path and into a second flow path;

pre-spraying soiled surfaces by:

providing a pre-spray;

providing an adjustable proportional pump in the first flow path;

directing the stream of water in the first flow path through the proportional pump;

driving the proportional pump with the stream of water;

drawing a controllable amount of the pre-spray into the proportional pump;

releasing the controllable amount of pre-spray into the water stream flowing though the water proportional pump;

providing a diluted pre-spray in the first flow path having a pressure substantially the same pressure as the pressure of the water in the first flow path; and pre-spraying soiled surfaces with the diluted pre-spray; and rinsing pre-sprayed soiled surfaces by:

increasing the pressure of the water directed into the second flow path to an operating pressure suitable for rinsing soiled surfaces; and spraying the increased-pressure stream of water in the second flow path on the pre-sprayed soiled surfaces, wherein the operations of pre-spraying soiled surfaces and rinsing pre-sprayed soiled surfaces are adapted to be performed substantially concurrently.

2. The method of claim 1 wherein, after the operation of increasing the pressure of the water directed into the second flow path:

providing a diluted rinse agent;

providing an adjustable injector in the second flow path;

directing the operating-pressure stream of water in the second flow path through the injector;

injecting a controllable amount of the diluted rinse agent into the operating-pressure stream of water flowing though the injector; and providing a diluted rinsed agent in the second flow path, wherein the operation of spraying the increased-pressure stream of water in the second flow path comprises spraying the diluted rinse agent in the second flow path on the pre-sprayed soiled surfaces.

3. The method of claim 2 wherein, after the operation of pre-spraying soiled surfaces, allowing the diluted pre-spray to dwell on pre-sprayed soiled surfaces for a dwell time appropriate for the diluted pre-spray to loosen the soil on the soiled surfaces, wherein the operation of pre-spraying is adapted to be performed concurrently with the spraying of the diluted rinse agent on pre-sprayed soiled surfaces having elapsed dwell times.

4. The method of claim 3, wherein the operation of spraying the increased-pressure stream of water in the second flow path further comprises an operation of extracting residue from the pre-sprayed soiled surfaces.

5. The method of claim 4, further comprising the operations of:

directing the stream of water from the service line into a plurality of additional flow paths;

performing the operation of pre-spraying soiled surfaces on at least one additional flow path; and performing the operation of rinsing pre-sprayed soiled surfaces on at least another additional flow path.

6. The method of claim 1, wherein the operation of supplying the stream of water from the water service line comprises:

providing a first reel with a hollow drum having a length of supply hose wound thereon;

providing the first reel with a fluid path communicating through the hollow drum between an end of the supply hose and a T-fitting on a side of the hollow drum; and connecting the opposite end of the supply hose to the water service line;

wherein the operation of directing the stream of water from the service line comprises:

directing the service line water though the supply hose, through the fluid path, through the T-fitting, and to the first flow path and the second flow path; and wherein the operation of pre-spraying soiled surfaces comprises:

providing a second reel having a length of spray hose wound thereon and a spray gun connected to one end of the spray hose, with the opposite end of the spray hose provided in fluid communication with the proportional pump; and providing a connecting hose, a second reel, a spray hose, and a spray gun, in addition to the proportional pump, in the first flow path.

* * * * *